US005224228A

United States Patent [19]

Larrimore

[11] Patent Number: 5,224,228

[45] Date of Patent: Jul. 6, 1993

[54] LONGITUDINALLY SPLIT, MOTOR OPERATED BUTTERFLY BED

[76] Inventor: James R. Larrimore, 205 Vernon Ave., Glen Burnie, Md. 21061

[21] Appl. No.: 899,692

[22] Filed: Jun. 17, 1992

[51] Int. Cl.[5] ..... A61G 7/008; A61G 7/018

[52] U.S. Cl. ..... 5/613; 5/607; 5/465; 5/927

[58] Field of Search ..... 5/613, 607, 614, 616, 5/600, 927, 465, 424

[56] References Cited

U.S. PATENT DOCUMENTS

| | | | |
|---|---|---|---|
| 2,113,286 | 2/1936 | White | 5/607 |
| 3,230,554 | 1/1966 | Peterson | 5/618 |
| 4,225,988 | 10/1980 | Cary et al. | 5/607 |
| 4,375,706 | 3/1983 | Finnhult | 5/607 |
| 4,563,784 | 1/1986 | Shrock et al. | 5/927 |
| 4,658,451 | 4/1987 | Taniguchi | 5/607 |

*Primary Examiner*—Alexander Grosz
*Attorney, Agent, or Firm*—Richard C. Litman

[57] ABSTRACT

An adjustable bed is provided with two frames which rotate about the longitudinal axis of the bed. The rotation is facilitated by a plurality of motors mounted on an undercarriage in which the two frames nest. The motors are controlled by a control unit, which when actuated causes raising or lowering of the nested frames relative to the undercarriage. One or both frames may be raised or lowered at the same time. A limit switch is placed on the frames which prevents the angle formed by the two frames from becoming less than ninety degrees.

8 Claims, 2 Drawing Sheets

LONGITUDINALLY SPLIT, MOTOR OPERATED BUTTERFLY BED

FIELD OF THE INVENTION

The present invention relates to adjustable beds. More specifically this invention relates to beds where the frame and mattress are divided in a longitudinal fashion and are remotely controlled.

DESCRIPTION OF THE PRIOR ART

Adjustable beds are known in the art. U.S. Pat. No. 554,580 issued to Cronkwright discloses two adjustable and removable bed sections separated longitudinally where both the frame and mattress are divided longitudinally and can manually be raised about 90 degrees from horizontal with respect to one another.

U.S. Pat. No. 2,113,286 issued to White discloses a hospital bed where the frame and mattress are divided longitudinally and each section pivots 90 degrees from the horizontal. The hospital bed has guardrails and the pivotal movement is accomplished in a manual fashion. The bed is secured in an angular position through the use of support members resting in notches.

U.S. Pat. No. 3,230,554 issued to Peterson discloses a motion regulator device to control the relative movement of objects. This device uses a motorized power screw to regulate relative motion in mechanical systems. The device relates specifically to the application of such devices to adjustable beds, chairs or sofas to regulate relative movement between various sections thereof.

U.S. Pat. No. 4,658,451 issued to Taniguchi discloses a carrier for supporting a person in different postural positions. It contains a hydraulic drive means for pivoting the main rest area to allow the patient to be turned over, supported on their side or transferred.

None of the above inventions and patents, taken either singly or in combination, is seen to describe the instant invention as claimed.

SUMMARY OF THE INVENTION

The present invention is designed to increase comfort and ease of human motion in a bed. The occupant has complete control in raising either wing, rotating them on either side of a central longitudinal axis, allowing body weight to be dispersed through both mattress planes rather than through just one. This greatly relieves concentrated points of pressure on the body and provides improved comfort and meaningful rest. Body position can be easily changed at any time by the reclining occupant of the bed. Often one is restricted to a bed for long periods of time due to illness or infirmity. In this case it is desirable to have a resilient surface which conforms to the body form and would distribute the body weight over as large a bearing surface as possible and would relieve body weight concentrations on any given point. In conventional beds the bearing surface of the body has been limited to one body plane, i.e.: the side, back or stomach. This is one of the reasons why sleepers turn in their sleep; to relieve the discomfort caused by pressure exerted on a single body plane.

Also, those who are confined to bed often develop decubitus ulcers. The best treatment for injuries of this type is prevention. It is recommended that a bedridden patient's position be changed often, in many cases once every 2 hours. Other medical procedures require a patient be kept on their side, such as certain kidney operations.

Also there exists a need for immobile users to turn from side to side without assistance. Most conventional beds would require a nurse or an orderly to provide that function.

A bed is provided which provides a solution to these problems. This bed permits rotation of two wings on the longitudinal axis by a hand held, easily actuated electrical control box. Two offset motors propel power screws which in turn raise or lower the two wings of the bed. A limit switch prevents the angle between the two wings from becoming less than 90 degrees. It also allows either the person in bed, or another person, to control the angle between the wings.

Accordingly, one object of the present invention is to provide an easily adjustable bed in which the user can adjust the wings to meet their personal comfort needs.

Another object of the instant invention is to provide a bed which distributes the body weight through two adjustable planes.

Another object of the instant invention is to provide a bed in which the occupant can simply and easily adjust the angle between either wing of the mattress relative to a hypothetical plane generally parallel to the floor.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
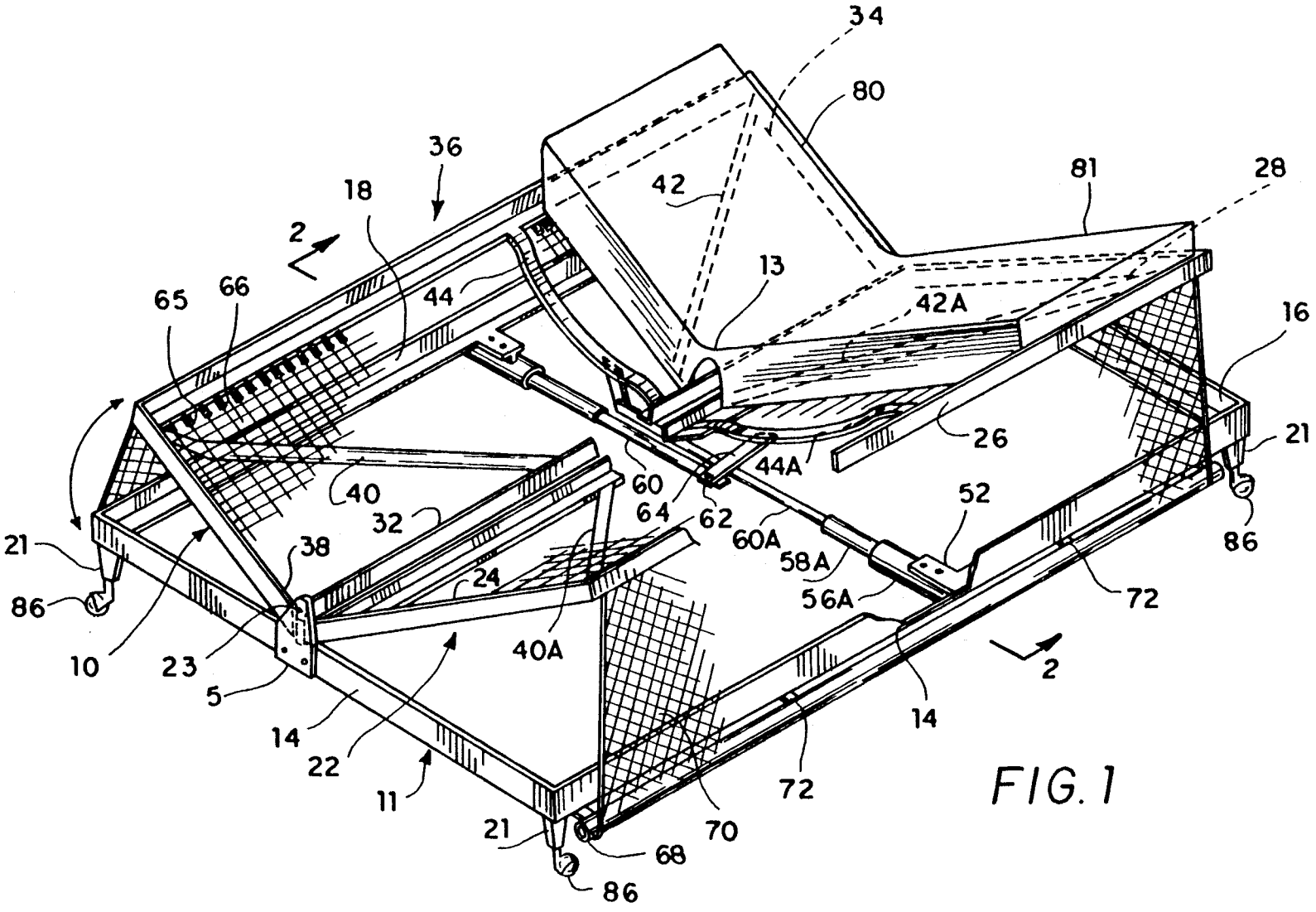
FIG. 1 is a top perspective view of the bed.
Figure 2:
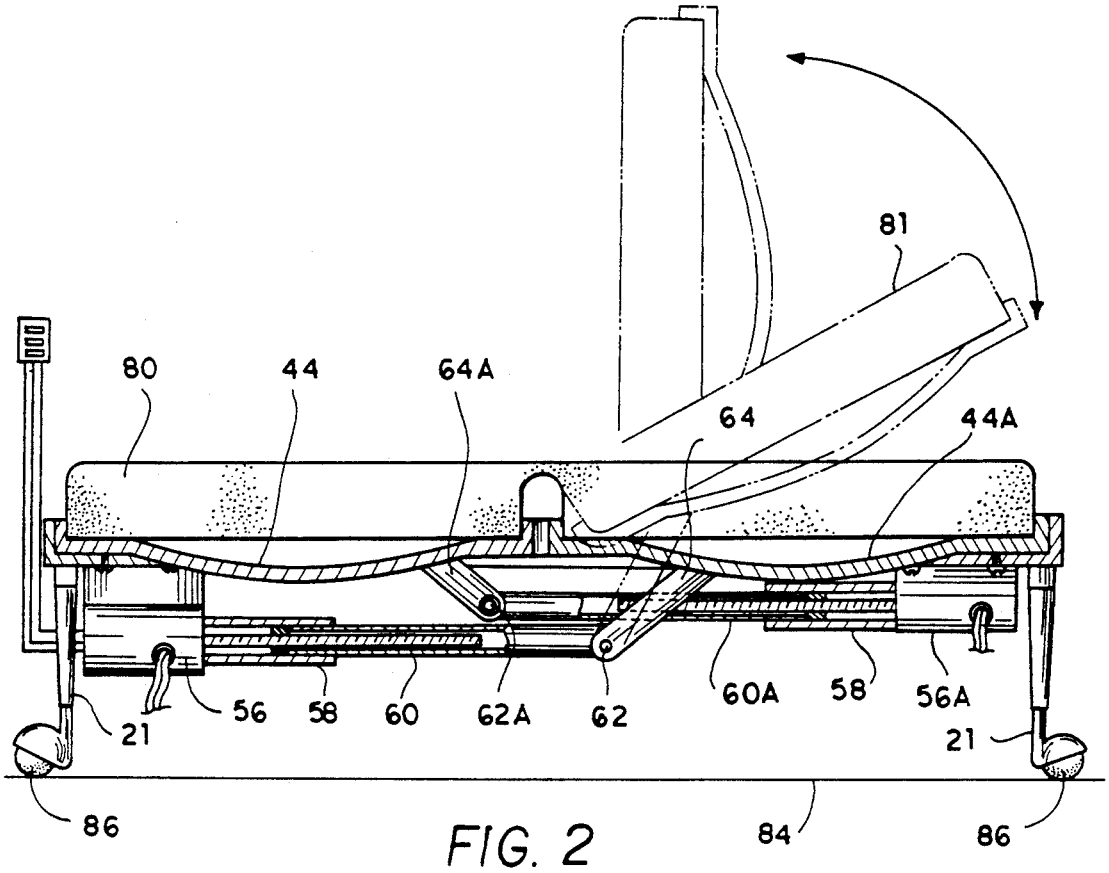
FIG. 2 is an end view of the bed taken along line 2—2 of FIG. 1.
Figure 3:
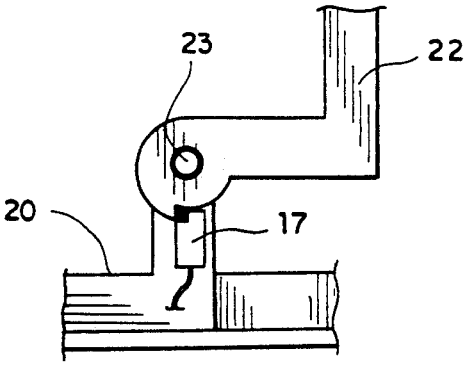
FIG. 3 shows the limit switch on the hinge connection.

The bed is provided with two independent wings which split the bed in two along the longitudinal axis. These wings are independent rectangular frames which are connected together at both top and bottom by a pair of pivot pins 23, respectively. The wings rotate about these pivot pins 23 which forms a centerline. This centerline is the axis of the wing rotation and defines the longitudinal axis itself.

The adjustable bed is provided with an undercarriage 11 which has both a longitudinal and transverse axis. The undercarriage 11 has a top 16, bottom 12, right 14 and left side 18 and is composed of standard angle irons. The undercarriage 11 is brought off the floor 84 by four leg posts 21, which are in the form of a left pair of leg posts and a right pair of leg posts, each supported by a corresponding left or right roller 86, and is in a rectangular configuration.

Two frames (20,22) fit inside of the undercarriage 11. The right frame 22 has top 28, bottom 24, inside 30 and outside 26 frame members. The left frame 20 has top 34, bottom 38, inside 32, and outside 36 frame members. The frames (20,22) are dimensioned to be the same length and width.

The two frames (20,22) are mounted on the undercarriage 11 by an top and a bottom mounting plate 5. (Note: Only the bottom mounting plate 5 is shown in FIG. 1.) The two frames (20, 22) are connected to each other by pivot pins 23.

The inside (30,32) and outside members (26,36) of the frames (20,22) are slightly smaller than the dimension of the right side and left side members (14,18) of the undercarriage 11 and the frame members (30,32 and 26,36) are designed to fit interiorly of the undercarriage 11 with a nominal tolerance. The top (28,34) and bottom (24,38) members of the frames (20,22) are slightly smaller than about one-half the dimension of the top and bottom members (16,12) of the undercarriage 11 and the frame members (28,34 and 24,38) are again designed to fit interiorly of the undercarriage 11. The two rectangular frames (20,22) rest on the bottom part of the angle irons which comprise the undercarriage 11. The two frames (20,22) are hinged by pivot 23 at both the bottom (24,38) and top (28,34) of their inside frame members (30,32). This permits rotation of the frames (20,22) about the pivot pin 23 along the longitudinal line formed by the centerline between the two proximal inside frame members (30,32). When both frames (20,22) are in their resting state, the bed is flat and an angle of 180 degrees is maintained. A limit switch 17 is placed on the right frame 20 which permits a minimum angle of 90 degrees to be formed between the two frames. This 90 degree angle can be in any configuration from an L-shape to a V-shape.

The two frames (20,22) are provided with standard bed springs 65 which tension support wires 66 which run in a criss-cross pattern across the two frames (FIG. 1).

The two frames (20,22) have an internal frame support network. The right frame 22 and the left frame 20 lie in a side by side fashion along the longitudinal centerline axis of the undercarriage 11. The internal frame support network is composed of support members. These members are configured identically for both the left frame 20 and the right frames 22. A first support member (44, 44A) is placed on the frame (20,22) in a transverse manner about the approximate center of the frame (20,22). This connects the outside frame member (36,26) to the inside frame member (32,30). A second support member (42, 42A) is placed diagonally connecting the inside frame member (30,32) with the outside frame member (36,26). A third support member (40, 40A) is placed diagonally and connects the inside frame member (32,30) to the outside frame member (36,26). These support members are in the shape of a truncated triangle and are placed on the underside of the frame (20,22). In this fashion no contact is made between the interior frame portions and the frame support members.

The undercarriage 11 has two motor mounts (52,54) located on both the right and left sides (14,18). These motor mounts (52,54) are located on the bottom of the L of the angle irons forming sides 14 and 18 and are located about approximately the center of the undercarriage 11. The motor mounts (52,54) are interior of the rectangle formed by the angle irons forming sides (14,18) of the undercarriage 11. The right motor mounts 52 is located underneath the right frame 22 and on the underside of the right side 14 of the undercarriage 11. The left motor mount 54 is located underneath the left frame 20 and on the underside of the left side 18 of the undercarriage 11. A right motor 56A is attached to the right motor mount 52 and a left motor 56 is attached to the left motor mount 54. Both motors (56,56A) face inward and each of them have an extensible and retractable cylindrical screw (60,60A) attached. There is a right extendible and retractable screw 60A and a left extendible and retractable screw 60 attached to the right 56A and left 56 motors, respectively. The first screw 60A is pivotally connected at pivot 62A to a left strut 64A, and the left screw 60 is likewise attached at pivot 62 to a right strut 64. The left strut 64A is welded to the left support member 44 of the left frame 20. The right strut 64 is welded to the right support member 44A of the right frame 22.

As the right motor 56A is engaged in a forward fashion, the right screw 60A rotates and as a result extends. This extension pivots the left strut 64A thus raising the left frame 20 off the undercarriage 11 about the longitudinal centerline formed by pivot pins 23. When the right motor 56A is engaged in the opposite or rearward fashion, the right screw 60A retracts. This retraction pulls the left strut 64A back thus lowering the left frame 20. When fully retracted, left frame 20 lies flat, and when fully extended, the left frame 20 is at 90 degrees relative to the plane generally formed by the undercarriage 11. Right screw 60A is housed in cylindrical right screw housing 58A.

As the left motor 56 is engaged the exact same sequence of events occur for the right frame 22. The right strut 64 causes rotation of the right frame 22 about the pivot pins 23 as the left screw 60 is extended or retracted. When fully retracted the right frame 22 lies flat and when fully extended the right frame is at 90 degrees relative to the plane generally formed by undercarriage 11. Left screw 60 is housed in cylindrical left screw housing 58.

A conventional electromechanical limit switch 17, used as a rotation control mean is placed on the right frame 22. This limits the angle between the two frames (20,22) to no less than 90 degrees. The rotation of the frames (20,22) is about the pivot pins 23.

A nylon mesh screen 70 is placed on the outside frame members (26,36) of both the right and left frame (22,20). As the frame (22,20) rotates from 180 degrees to 90 degrees the mesh screen 70 comes off a spring tension roller 68 and is dimensioned to fit along the entire outside length of the frame member (26,36). The roller 68 is secured to the right and left side (14,18) of the undercarriage 11. This nylon mesh screen 70 creates a physical barrier which will prevent foreign objects from fouling the motors (56,56A).

A special mattress 72 is employed. The mattress 72 has a right section 81 and a left section 80 which lay atop the right and left frame (22,20) respectively. Where the inside frame members (32,30) of the left and right frame (20,22) are proximal, an inverted conical portion 73 is cut from the mattress 72. The inverted conical portion 73 transits the entire longitudinal length of mattress 72.

It is to be understood that the present invention is not limited to the sole embodiment described above, but encompasses any and all embodiments within the scope of the following claims.

I claim:

1. An adjustable bed having a longitudinal and transverse axis comprising:

an undercarriage;

two pivot support plates connected to said undercarriage;

a first and a second frame nested in said undercarriage;

pivot means connecting said first frame to said second frame and further to said support plates;

said pivot means defining a longitudinal axis;

a plurality of first and second frame support elements connected to said first frame and said second frame, respectively;

a first and second frame rotation means located at said transverse axis connected to one of said first frame support elements and one of said second frame support elements, respectively;

rotational control means connected to said first and second frame rotation means, respectively; and said rotational control means comprising a limit switch mounted on one of said first and second frames, whereby an angle formed between said first and second frames is constrained to be at least ninety degrees and whereby said first and second frames are rotatable about said bed longitudinal axis relative to each other when said rotational control means is not actuated.

2. An adjustable bed as claimed in claim 1 where said first and second frame each have a top, bottom, inside and outside frame member.

3. An adjustable bed as claimed in claim 1 where said pivot means comprises a pin whereby said first and second frame are rotatable about said pin.

4. An adjustable bed as claimed in claim 1 where said frame rotation means includes a plurality of motors.

5. An adjustable bed as claimed in claim 4 where said frame rotation means further includes a plurality of extensible and retractable screw members respectively attached to said motors and further respectively connected to a plurality of linkages, said linkages are connected to said one of said frame support elements whereby when said motors are actuated, said screw member either extends or retracts, causing said frame member to rotate about said longitudinal axis.

6. An adjustable bed as claimed in claim 4 including a mesh net connected to said first and second frame respectively, and further connected to said undercarriage whereby said mesh net prevents foreign objects from fouling said motors.

7. An adjustable bed as claimed in claim 1 including a mattress, said mattress designed to lay atop said first and second frame, said mattress having a longitudinal parabolic cut parallel to said longitudinal axis, whereby said mattress can rotate along with said first or said second frame.

8. An adjustable bed as claimed in claim 1 whereby said undercarriage has four mounting posts each having a roller, whereby said posts elevate said undercarriage off a supporting surface.

* * * * *